United States Patent [19]

Sugiyama

[11] Patent Number: 4,601,103

[45] Date of Patent: Jul. 22, 1986

[54] CUTTER HAVING CIRCULAR ROTARY BLADE

[75] Inventor: Makoto Sugiyama, Seki, Japan

[73] Assignee: Kai Cutlery Center Co., Ltd., Seki, Japan

[21] Appl. No.: 684,856

[22] Filed: Dec. 21, 1984

[30] Foreign Application Priority Data

Jun. 26, 1984 [JP] Japan ..... 59-95813[U]

[51] Int. Cl.[4] ..... B26B 25/00

[52] U.S. Cl. ..... 30/162; 30/292; 30/307; 30/319

[58] Field of Search ..... 30/162, 307, 319, 276, 30/292

[56] References Cited

U.S. PATENT DOCUMENTS

| | | | |
|---|---|---|---|
| 435,627 | 9/1890 | Hardy | 30/319 |
| 1,559,724 | 11/1925 | Meader | 30/319 X |
| 4,301,594 | 11/1981 | Okada | 30/307 X |
| 4,432,137 | 2/1984 | Okada | 30/307 X |

FOREIGN PATENT DOCUMENTS 58-49674 4/1983 Japan .

*Primary Examiner*—James M. Meister
*Assistant Examiner*—John L. Knoble
*Attorney, Agent, or Firm*—Leydig, Voit & Mayer, Ltd.

[57] ABSTRACT

A cutter having a circular rotary blade comprises: a handle; a blade mounting section formed on one end of the handle; a circular blade secured to one side of the blade mounting section and rotatably carried at its central portion; a slot having an opening formed in the blade mounting section at a position behind the central portion of the circular disc and corresponding to the circular blade; a pressing member movably received in the slot and projectable through the opening of the slot into pressure contact with one side of the circular blade; and an operation member adapted to limit the movement of the pressing member so as to adjust the pressure of contact between the pressing member and the circular blade, the operation member being held in engagement with the pressing member through cam means and positioned on the opposite side of the blade mounting section to the circular blade.

7 Claims, 5 Drawing Figures

CUTTER HAVING CIRCULAR ROTARY BLADE

BACKGROUND OF THE INVENTION

1. Field of the Invention

The present invention relates to a cutter having a circular rotary blade which is rotatably supported at its center on one side of a blade mounting portion of a handle. More particularly, the invention is concerned with a cutter of the above-mentioned type wherein the resistance to rotation of the circular blade is adjustable according to the kind of the object to be cut.

2. Description of the Prior Art

Japanese Utility Model Laid-Open No. 49674/1983 discloses a cutter having a circular rotary blade. In this cutter, the circular blade has a tendency that the peripheral edge of the blade is resiliently deformed over the entire circumference in an undulating manner during the rotation of the blade. The cut end of the object cut by such an undulating edge is curved undesirably.

SUMMARY OF THE INVENTION

Accordingly, an object of the invention is to provide a cutter having a circular rotary blade, wherein the undulation of the circular disc when the disc is rotated against a certain resistance thereby preventing the cut end of an object from being curved.

Another object of the invention is to provide a cutter having a circular rotary blade, wherein the resistance to the rotation of the blade is adjustable in accordance with the kind of the object to be cut.

Still another object of the invention is to provide a cutter having a circular rotary blade, wherein the rotation of the circular blade during the cutting operation is controlled by adjustment of the frictioning condition.

A further object of the invention is to provide a cutter having a circular rotary blade, improved to facilitate the visual check of the cutting edge of the circular blade during cutting of the object.

A still further object of the invention is to provide a cutter having a circular rotary blade, improved to prevent projection of the cutting edge of the blade when the cutter is not used.

A still further object of the invention is to provide a cutter having a circular rotary blade, wherein, when the cutter is used, the cutting edge of the blade can be projected beyond a protective member not only towards the end of the handle but also on the breadthwise direction of the handle.

To these ends, according to the invention, there is provided a cutter having a circular rotary blade comprising: a handle; a blade mounting portion formed on one end of the handle; a circular blade secured to one side of the blade mounting portion and rotatably carried at its central portion; a slot having an opening formed in the blade mounting section at a position behind the central portion of the circular disc and corresponding to the circular blade; a pressing member movably received in the slot and projectable through the opening of the slot into pressure contact with one side of the circular blade; and an operation member adapted to limit the movement of the pressing member so as to adjust the pressure of contact between the pressing member and the circular blade, the operation member being held in engagement with the pressing member through cam means and positioned on the opposite side of the blade mounting section to the circular blade.

These and other objects of the invention will become clear from the following description of the preferred embodiments. Features and advantages of the invention which are not specifically mentioned in the specification will be realized by those skilled in the art carrying out this invention.

DESCRIPTION OF THE PREFERRED EMBODIMENT

Figure 1:
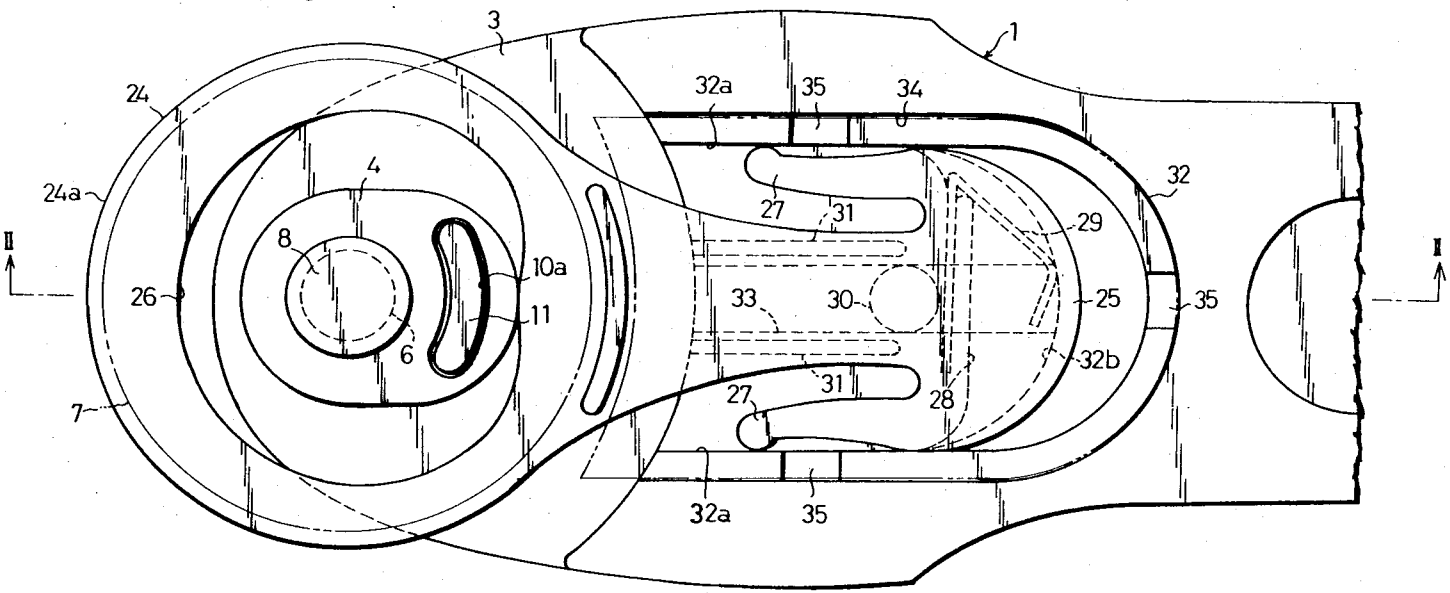
FIG. 1 is a partial front elevational view of a cutter having a circular rotary blade embodying the present invention.
Figure 2:
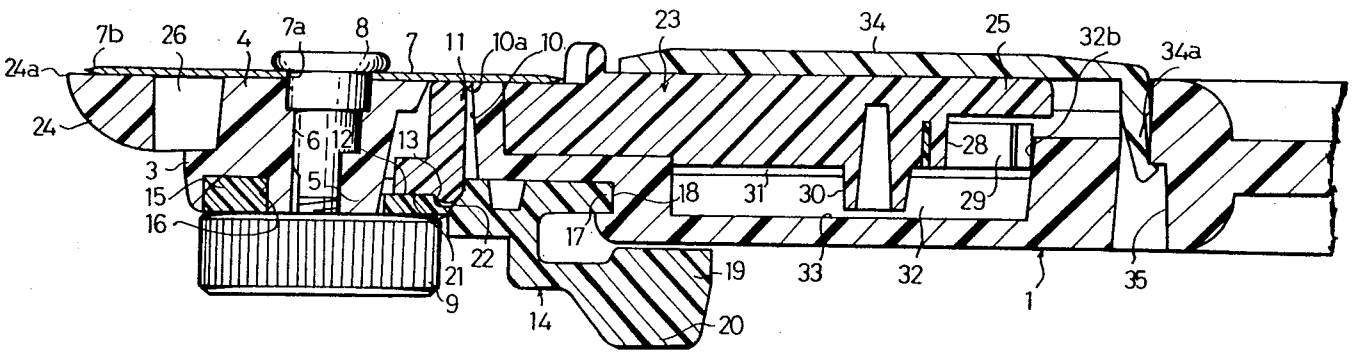
FIG. 2 is a sectional view taken along the line II—II of FIG. 1.

A preferred embodiment of the invention will be described hereinunder with reference to the accompanying drawings.

The cutter in accordance with the invention has a handle 1 which is provided at its front end with a blade mounting section 3 on both sides of which are formed suporting portions 4,5. A supporting hole 6 is formed to extend from one to the other of these supporting portions 4 and 5. A circular blade 7 is laid on one 4 of the supporting portions. A stopper screw 8 is extended through a central hole 7*a* in the blade 7 into the supporting bore 6 not rotatably. A nut 9 is screwed to the end of the screw 8 projecting out of the other supporting portion 5 until it tightly contacts the surface of the supporting portion 5. In this state, the circular blade 7 is pressed at a suitable level of pressure onto the supporting portion 4 by the tension acting on the stopper screw 8, so that the blade 7 is rotatable with a certain level of friction resistance.

A slit 10 is formed in the supporting portion 4 of the blade mounting portion 3. The slit 10 has an opening 10*a* which spreads at the rear side of the central hole 7*a* of the blade 7 over an arcuate region corresponding to a certain circumferential length of the rear part of the central hole 7*a*, and extends vertically from the supporting portion 4 to a rear part of the other supporting portion 5. A pressing member 11 received in the slot 10 is adapted to be moved in the direction substantially perpendicular to the plane of the circular blade 7 such as to be pressed to the lower side of the blade 7 through the opening 10*a*.

An operation member 14 has a base 15 which is slidably superposed to the surface of the blade mounting section 3 opposite to the blade 7. The base 15 has a hole 16 which rotatably receives the supporting portion 5. A guide projection 17 projected from the rear end of the base 15 movably fits in a guide groove 18 formed in the rear end portion of the blade mounting portion 3.

A manipulation tab 19 projected rearwardly from the rear end of the base 15 is slidably superposed to an outer surface of the handle 1. A finger-retaining portion 20 is formed on the manipulation tab 19. The pressing member 11 and the operation member 14 engage with each other at their slant engaging surfaces 12,21 serving as cam surfaces. The arrangement is such that a plurality of retaining projections 13 formed on the engaging surface 12 of the pressing member 11 are received in corresponding recesses 22 formed in the engaging surface 21 of the operation member 14.

Figure 5:
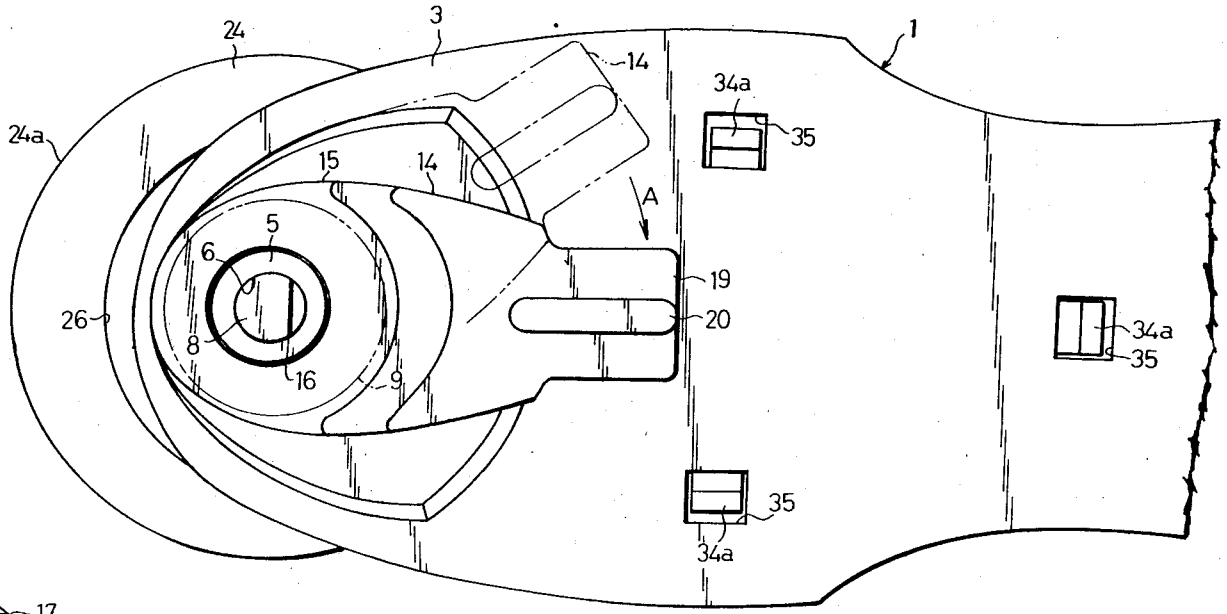
FIG. 5 is a partial rear elevational view of the cutter in accordance with the invention having a circular rotary blade.
Figure 4:
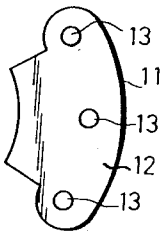
FIG. 4 is a bottom plan view of a pressing member showing an engaging surface thereof.
Figure 3:
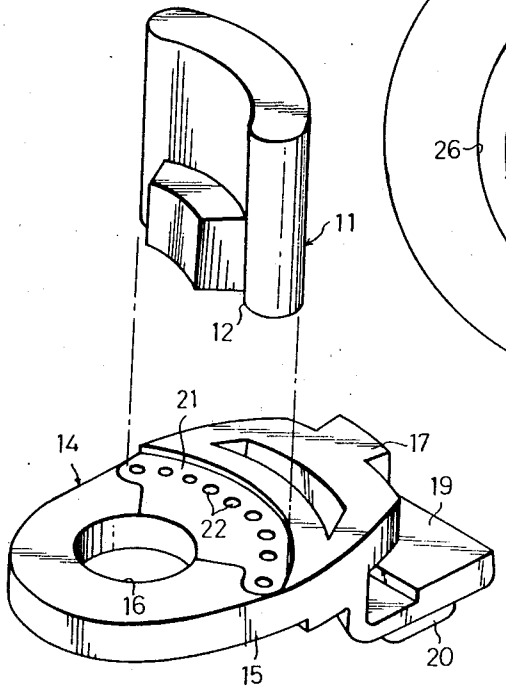
FIG. 3 is an exploded perspective view of the cutter showing specifically a pressing member and an operation member.

When the operation member 14 is rotationally slided in the direction of an arrow A in FIG. 5, the pressing member 11 is raised due to the cam effect of the slant engaging surfaces 12,21. As a result, the pressing member 11 projects through the opening 10*a* of the slot 10 towards the circular blade 7 so as to make a pressure contact therewith, so that a frictional resistance of a level corresponding to the contact pressure is produced to resist the rotation of the disc 7. The pressing member 11 is held at the projecting position due to the engagement between the projections 13 on the pressing member 11 and the recesses 22 in the operation member 14. The contact pressure between the pressing member 11 and the circular blade 7 is adjustable through varying the amount of projection of the pressing member 11 which in turn is caused by rotating the operation member 14 to vary the position of engagement between both slant engaging surfaces 12 and 21.

The protective member 23 is composed of a disc portion 24 greater in diameter than the circular disc 7 and a base portion 25 projected from the rear portion of the disc portion 24. The peripheral portion of the disc 24 constitutes a back-up portion 24*a* which backs up the cutting edge portion of the circular blade 7. An aperture 26 large enough to permit the movement of the disc 7 is formed in the central portion of the disc portion 24. A pair of leaf springs 27 extend forwardly from both lateral sides of the base portion 25 of the protective member 23. On the other hand, a leaf spring 29 is loaded to act on a step surface 28 formed in the rear portion of the bottom surface of the base portion 25. A guide projection 30 is formed on the bottom surface of the base portion 25 of the protective member 23 at a position ahead of the leaf spring 29. A pair of guide ridges 31 extend longitudinally of the handle 1 at both sides of the guide projection 30.

The protective member 23 fits in a space defined by the inner surface of the circular blade 7 and one lateral side of the blade mounting section 3 of the handle, when the circular blade 7 is pressed onto the supporting portion 4 of the blade mounting portion 3. In this state, the supporting portion 4 is loosely received in the aperture 26 formed in the disc portion 24. A space for allowing the movement of the protective member 23 is formed between the inner peripheral surface of the aperture 26 and the outer peripheral surface of the supporting portion 4. At the same time, the base portion 25 of the protective member 23 fits in a recess 32 formed in the front end portion of the handle 1. In this state, the guide projection 30 on the base portion 25 of the protective member 23 is slidably received in a guide groove 33 formed in the bottom of the recess 32 so as to extend longitudinally of the handle 1. In addition, the leaf springs 27 on both lateral sides of the base portion 25 resiliently contact opposing side walls 32*a* of the recess 32, and the leaf spring 29 provided on the rear end of the base portion 25 abuts the step 32*b* on the rear end of the recess 32.

Therefore, the protective member 23 is swingable to the left and right about the axis of the guide projection 30 over an area limited by the aperture 26 in the breadthwise direction of the handle 1, overcoming the resilient force exerted by respective leaf springs 27. The protective member 23 is movable also in the longitudinal direction of the handle 1 along the guide groove 33 against the leaf spring 29.

When the cutter is not used, the supporting portion 4 of the blade mounting section 3 is centralized in the aperture 26 due to balance of resilient forces exerted by the leaf springs 27. At the same time, the protective member 23 is urged resiliently in the forward direction by the force of the leaf spring 29, but the edge 7*b* of the circular blade 7 is prevented by the back-up portion 24*a* of the disc portion 24 from projecting outwardly. A cover 34 is placed to overlie the recess 32 with its three legs 34*a* retained by retaining holes 35 in the recess 32, thereby covering the base portion 25 of the protective member 23.

In the use of the cutter of the invention having the circular rotary blade, the pressure of the contact between the pressing member 11 and the circular disc 7 is adjusted in accordance with the kind of the material to be cut, in a manner explained before. Subsequently, handle 1 is placed at a suitable angle of inclination to the object to be cut and is moved in the direction of cutting while the circular disc 7 is pressed onto the object to be cut. As a result, the protective member 23 is moved in the longitudinal or breadthwise direction of the handle 1 while making contact with one side of the circular blade 7, in accordance with the angle of inclination of the handle 1. Meanwhile, the back-up portion 24*a* slides on the object to be cut, while the edge 7*b* of the circular blade 7 projects in any direction beyond the back-up portion 24*a* to cut into the object to be cut. Consequently, the circular blade 7 rolls on the object to be cut, while making a slight slip on the object to be cut. After the use, as the protective member 23 is automatically retracted to the inoperative position by the resilient force of the leaf spring 29.

As has been described, since the circular blade of the invention is pressed at its portion behind the central bore 7*a*, the cutting edge 7*b* on the front side of the circular blade 7 is not affected by the pressure exerted by the pressing member so that the object is cut to exhibit a linear cut end. At the same time, the pressing member 11 is always received in the hole 10 formed in the blade mounting portion 3, while the operating member 14 which engages with the pressing member 11 through the cam surfaces 12,21 is positioned on the side of the blade mounting section 3 opposite to the circular blade 7. Therefore, these members 11,14 do not project into the outer space facing the circular blade 7 so that the edge 7*b* of the circular blade 7 is visually checked easily from the upper side during the use of the cutter.

Although the invention has been described through specific terms, it is to be understood that the described embodiment of the invention is not exclusive and various changes and modifications may be imparted thereto without departing from the scope of the invention which is limited solely by the appended claims.

What is claimed is:

1. A cutter having a circular rotary blade comprising:

(a) a handle;

(b) a blade mounting section formed on one end of said handle;

(c) a circular blade secured to one side of said blade mounting section and rotatably carried at its central portion;

(d) a hole having an opening formed in the blade mounting section at a position behind the central portion of said circular disc and corresponding to said circular blade;

(e) a pressing member movably received in said hole and projectable through the opening of the hole into pressure contact with one side of said circular blade; and (f) an operation member adapted to limit the movement of said pressing member so as to adjust the pressure of contact between said pressing member and said circular blade, said operation member being held in engagement with said pressing member and positioned on the opposite side of said blade mounting section to said circular blade and further provided with a cam surface formed on the side thereof opposing said circular blade and adapted for engaging a cam surface formed on said pressing member.

2. A cutter having a circular rotary blade according to claim 1, wherein said blade mounting section has a supporting portion formed on one side thereof and contacting said circular blade and another supporting portion formed on the side thereof opposite to the supporting portion; a supporting hole extended from one to the other of said supporting portions; a stopper screw received in said supporting hole and adapted for supporting said circular disc; and a nut screwed to the end of said stopper screw and contacting said another supporting portion.

3. A cutter having a circular rotary blade according to claim 2, wherein said operation member is provided at its one end with a hole for rotatably receiving said supporting portion, while the other end is provided with a guide projection movably received by a guide groove formed in the blade mounting section and an actuating tab for rotationally operating the operation member.

4. A cutter having a circular rotary blade according to claim 1, wherein said pressing member is provided on the cam surface thereof with a plurality of projections while said operation member is provided in the cam surface thereof with a plurality of recesses engageable with said projections on said pressing member.

5. A cutter having a circular rotary blade comprising:

(a) a handle;

(b) a blade mounting section formed on one end of said handle;

(c) a circular blade secured to one side of said blade mounting section and rotatably carried at its central portion;

(d) a hole having an opening formed in the blade mounting section at a position behind the central portion of said circular blade and corresponding to said circular blade;

(e) a pressing member movably received in said hole and projectable through the opening of the hole into pressure contact with one side of said circular blade;

(f) an operation member adapted to limit the movement of said pressing member so as to adjust the pressure of contact between said pressing member and said circular blade, said operation member being held in engagement with said pressing member through cam means and positioned on the opposite side of said blade mounting section to said circular blade;

(g) a protective member adapted to protect the user's finger and so forth from being injured by the edge of said circular blade when the cutter is not being used, said protective member being attached to said handle for movement along the length of said handle; and (h) a recess formed in a portion of said handle for receiving a base portion of said protective member slidably in the longitudinal direction of said handle, said recess being provided at its both sides with a pair of side walls and in the bottom thereof with a guide groove for guiding the base portion of said protective member, while said base portion of said protective member is provided at both sides thereof with a pair of leaf springs adapted to be pressed onto the side walls of said recess, said base portion of said protective member being further provided on the bottom surface thereof with a guide projection movable in the longitudinal direction of a guide groove of the recess and adapted to constitute the center of swinging motion of said protective member.

6. A cutter having a circular rotary blade according to claim 5, wherein said base portion of said protective member is further provided on the bottom surface thereof with a pair of ridges formed at both sides of said guide projection and extending in the longitudinal direction of said base portion, said ridges contacting the bottom surface of said recess, said base portion of said protective member being further provided with a spring member secured to one end thereof and adapted to urge said protecting member as a whole always towards the end of said handle adjacent to said disc portion of said protective member.

7. A cutter having a circular rotary blade according to claim 6, wherein a cover for covering the base portion of said protective member is disposed to overlie said recess in said handle.

* * * * *